US005743164A

United States Patent [19]

Guez

[11] Patent Number: 5,743,164

[45] Date of Patent: Apr. 28, 1998

[54] AUTOMATIC RECONFIGURABLE DIE

[76] Inventor: Allon Guez, 560 Sprague Rd., Penn Valley, Pa. 19072

[21] Appl. No.: 609,391

[22] Filed: Mar. 1, 1996

[51] Int. Cl.[6] ..... B26D 1/00; B26D 3/08

[52] U.S. Cl. ..... 83/862; 83/883; 83/76.6; 83/563; 83/620; 83/696; 234/107

[58] Field of Search ..... 83/862, 76.1, 76.6, 83/76.9, 563, 575, 620, 657, 696, 698.71, 698.91, 699.31, 699.51, 883; 234/3, 107

[56] References Cited

U.S. PATENT DOCUMENTS

| | | | |
|---|---|---|---|
| 2,655,995 | 10/1953 | Whistler | 83/699.31 X |
| 3,530,748 | 9/1970 | Fuller | 83/620 X |
| 3,738,569 | 6/1973 | Killaly, Sr. | 83/620 X |
| 3,786,732 | 1/1974 | Forbes, Jr. | 83/862 X |
| 3,958,482 | 5/1976 | Claesson | 83/620 X |
| 4,916,990 | 4/1990 | Dolansky et al. | 83/76.6 X |
| 5,027,683 | 7/1991 | Kakimoto | 83/76.6 |
| 5,233,895 | 8/1993 | Coneski et al. | 234/107 X |

*Primary Examiner*—Eugenia Jones

[57] ABSTRACT

An automatic reconfigurable die having an array of knives, each of which is separately pivoted and extended along and about a respective longitudinal axis, to allow a desired contour to be scored and cut from a sheet material, according to a real time computer plan which is controlling the array of knives. The automatic reconfigurable die includes actuators associated with each knife to control, via information associated with a remote computer system, the extension and retraction, and orientation of the knives. The computer selects the appropriate setpoints for each knife in order to match the required shape/pattern of the cut by simple curve fitting methods. In this manner, a selected plurality of the knives in the array are chosen, oriented and extended in real time to score/cut the selected part.

16 Claims, 4 Drawing Sheets

AUTOMATIC RECONFIGURABLE DIE

BACKGROUND OF THE INVENTION

1. Field of the Invention

The present invention generally relates to a tool for cutting differently shaped patterns from sheet material including natural and artificial leather or hide, fabric, and paper. The tool includes a plurality of knives arranged in an array, and means for automatically configuring the plurality of knives to score/cut the sheet material in a desired contour.

2. Description of the Related Art

Conventional cutting tool are typically provided with a fixed cutting surface configuration. As such, the cutting process is encumbered by the fact that many cutting tools (dies) are required to cut a plurality of different shaped patterns from a sheet of material. Further, these dies have to be ordered and prepared ahead of time, introducing a manufacturing delay of several weeks. In addition, in order to efficiently complete a cutting process that requires a plurality of different shaped dies, bulky equipment that is capable of holding and manipulating all of these dies, is typically necessary.

The present invention reconfigurable die, thus, addresses the need for a single cutting tool that is capable of cutting many shapes of varying dimensions from a piece of material. The present invention eliminates the need for the bulky equipment necessary for carrying or housing a plurality of individual dies, and has the advantage of being quickly, completely and automatically reconfigurable up to a predetermined (desired/designed) resolution. This feature allows for accurate representation (of the outline) of the part; and, based on the combination of knives used and their respective shapes and sizes, a limitless number of different parts to be scored, cut, and/or extracted. Therefore, this tool is versatile enough to replace a load full of dies or cutting tools that only provide for a fixed number of shapes to be cut.

SUMMARY OF THE INVENTION

The present invention comprises an array of knives which can be pivoted and extended about and along their respective longitudinal axes. The combination of pivoting and extending a selection of these knives (from the array) allows the tool to approximate the desired contour to be scored/cut from a sheet material. Thus, it is an object of the present invention to provide an automatic reconfigurable die capable of cutting shapes of varying dimensions and sizes based upon selection, orientation and extension of the appropriate knives for each desired shape to be scored/cut. It is a further object of the present invention to provide an automatic reconfigurable die in which the selection process can be done on-line, for real time, delay-free configuration.

To realize the present invention, the automatic reconfigurable die includes a number of knives arranged in an array, all of which are individually actuated by two actuators. The first actuator rotates the knife about its longitudinal axis to the desired orientation, while the second generates a solenoid action to extend and retract the knife along its longitudinal axis. The size of each knife, including the width and length, and the number of knives in each row/column is application dependent. To that end, the automatic reconfigurable die may include small thin knives in the middle of the array to be utilized in the scoring of certain types of delicate fabrics or small patterns, and, conversely, longer thicker knives in the outer perimeter to be utilized in the scoring of thicker/tougher materials or larger patterns. However, it should be realized that the arrangement of the plurality of knives in the die can be variable and not be individualized in this sense, since each of the knives can be oriented and extended in the manner described herein to appropriately suit the application.

In operation, a selected number of knives are extended and rotated to form an approximation of the desired contour to be scored/cut/extracted. Such selection and positioning of the knives is performed automatically via operable communication between the automatic reconfigurable die and dedicated hardware, including a computer, and interfaced drivers.

Based on information supplied to the computer before the cutting procedure, the computer generates a plan (for each individual piece of material based on the information which contains type of material, outline and an optimized pattern layout, including individual contours) which is subsequently used in the selection and orientation of the knives. The drivers actuate the actuators to bring the selected knives in proper orientation and extension before a cut/score is made.

An additional feature of the present invention includes the fact that the knives are arranged in an array of rows and columns. The array need not be a square array, or symmetric in the number of knives in each row or column. Further, the variation in the dimensions of the knives plays a role in the obtainable resolution of the part to be scored/cut. It is important to note that the present invention automatic reconfigurable die can take on a variety of shapes without detracting from the spirit of the invention.

BRIEF DESCRIPTION OF THE DRAWINGS

The present invention is best understood with reference to the specification taken in conjunction with the figures as provided, wherein.

DETAILED DESCRIPTION OF INVENTION

Figure 1:
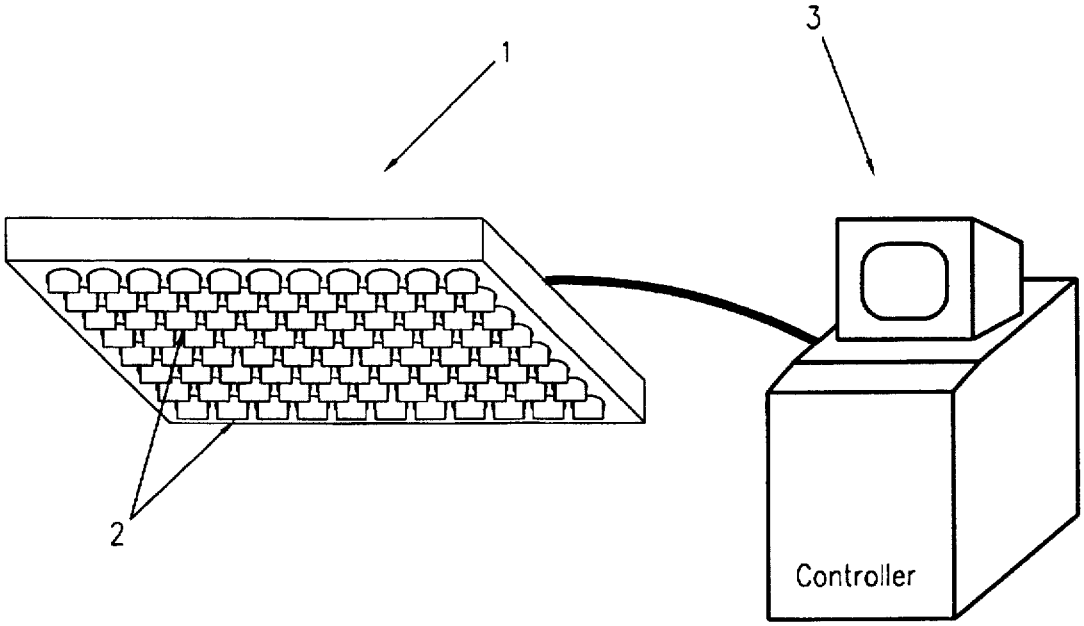
FIG. 1 is a schematic of the present invention automatic reconfigurable die shown interfaced with dedicated hardware.

The present invention relates to a automatic reconfigurable die for use in procedures involving the cutting of differently shaped patterns from sheet materials, including natural and artificial leathers or hides, fabrics, paper, etc. An overall schematic representing the automatic reconfigurable die 1 of the present invention is depicted in FIG. 1 (not to scale). As shown, the die 1 is interfaced with appropriate hardware means 3 for providing information to the die 1 that enables an arrangement of the knives 2 in a configuration that will allow the desired shape to be scored/cut. In this manner, the hardware means 3 serves as a controller/control means as will be further described herein.

Figure 2:
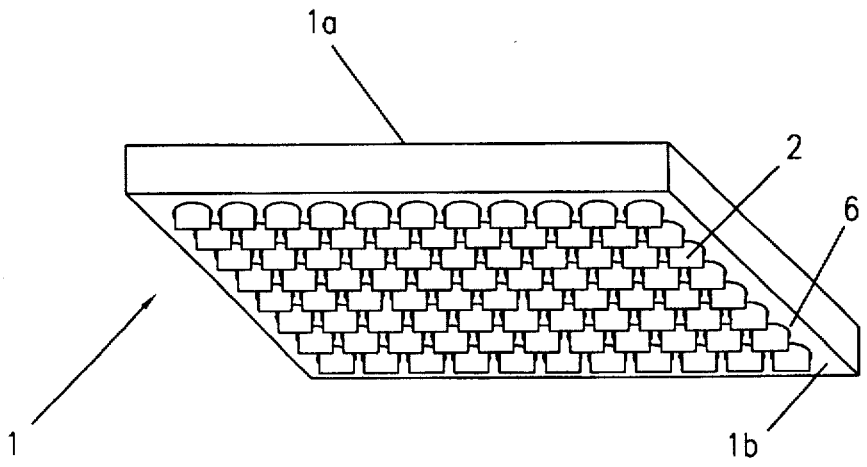
FIG. 2 is a perspective view of the present invention automatic reconfigurable die.

Referring now to FIG. 2, a perspective view of the present invention automatic reconfigurable die 1 is shown. The die 1 includes a top portion 1*a*, which may include means for attaching to the controller or means for attaching to any conventional die holding apparatus (not shown), and a bottom support base portion 1*b* having a plurality of knives 2 attached thereto. As shown, the plurality of knives 2 is arranged in an array of rows and columns. Each knife 2 sits in a circular casing 6 supported by the support plate 7 of the die, and is individually actuated by two actuators 4, 5. The actuator components are more fully described and depicted with reference to FIG. 4. It should be noted, that the size (width and length) of each knife and the number of these knives in each row/column is application dependent, and related to the desired/specified resolution and allowed tolerances for cutting/scoring.

Figure 2A:
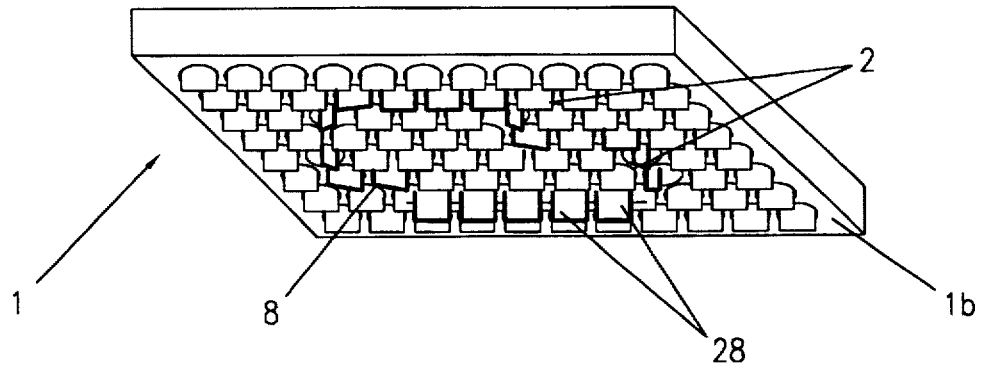
FIG. 2*a* is a perspective view of the present invention die of FIG. 2 depicting the extended/retracted knife components.
Figure 3:
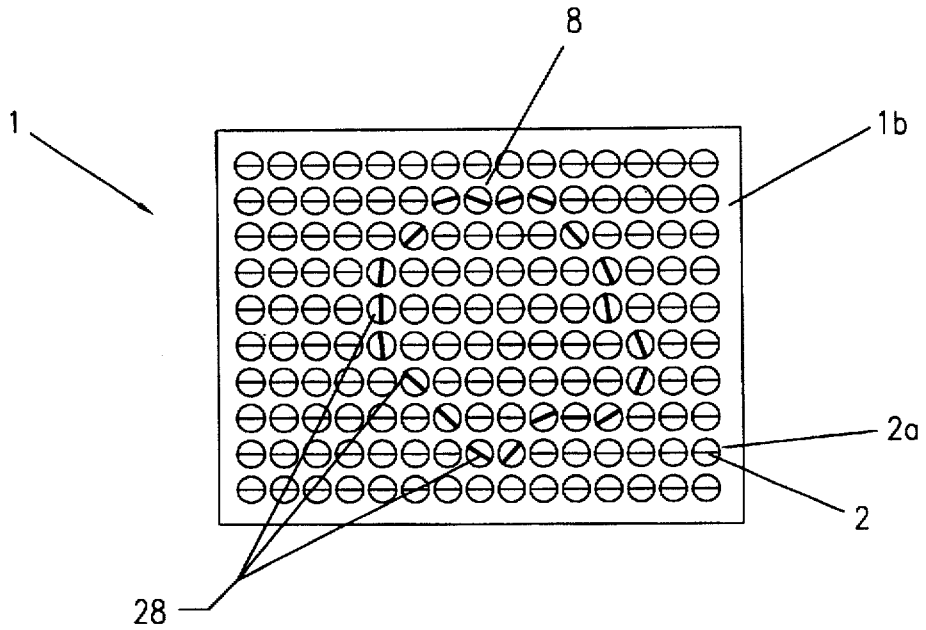
FIG. 3 is a bottom view of the die of FIG. 2 with a selected portion of the knives (shown in black as being extended) arranged in a pattern representing the desired contour to be scored and cut.

In operation, a selection of these knives 2 are extended and rotated to form an approximation of the desired contour 8 to be extracted by the cutting/scoring action of the automatic reconfigurable die 1. The desired contour 8 may be represented by a plurality of geometric and non-geometric shapes, polynomials or B-Spline curves. The generation of the appropriate orientations of a selection of knives is easily achieved by a selection of the knives that are closest to the norm of the desired contour, both in position and orientation. This operation is aided by the control means 3 which contains the information necessary for selecting the appropriate knives in real time operation. FIGS. 2*a* and 3 depict a perspective view and a bottom view, respectively, of the automatic reconfigurable die of FIG. 1, with a selected number 28 of the plurality of knives 2 being oriented and extended to approximate a continuous desired contour 8. The extensions of each of the selected knives 28 are represented by thick lines.

Figure 4:
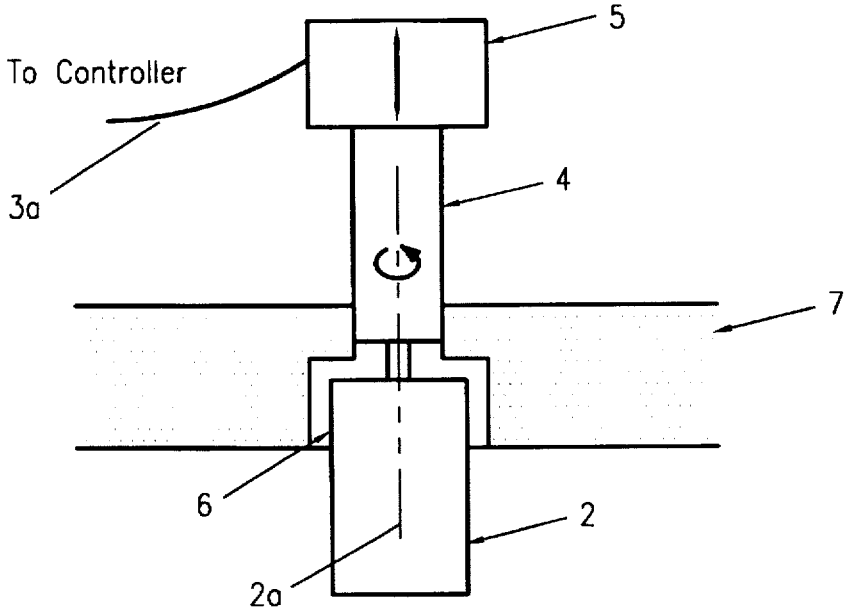
FIG. 4 is a sectional view of a knife/actuator of the present invention automatic reconfigurable die.

As mentioned previously, function of each knife 2 of the die 1 is facilitated by actuator means 4, 5. More specifically, one actuator/encoder 4 pivotably rotates the knife about its longitudinal axis 2*a* to the desired orientation, while the other actuator 5 generates a solenoid action to extend and retract the knife 2. The circular casing 6 of each knife 2 houses/is in operable communication with these actuator means 4, 5 as depicted in FIG. 4. Each knife 2/actuator unit 4, 5 is also in operable communication with the control means 3, 3*a* such that during operation, the control means 3, 3*a* appropriately commands a selected number of knives 28 to move (orient and extract) based on supplied information. In this manner, the selection, orientation, and extraction/retraction of the knives is automatically performed by dedicated hardware means 3 that includes a computer/processor, and interfaced drivers. Specifically, the computer selects and orients a group of knives based upon stored/supplied information, including the shape of the desired contour to be cut/scored. The drivers actuate the actuators to bring the selected knives in proper orientation and extension before a cut/score is made.

Figure 5:
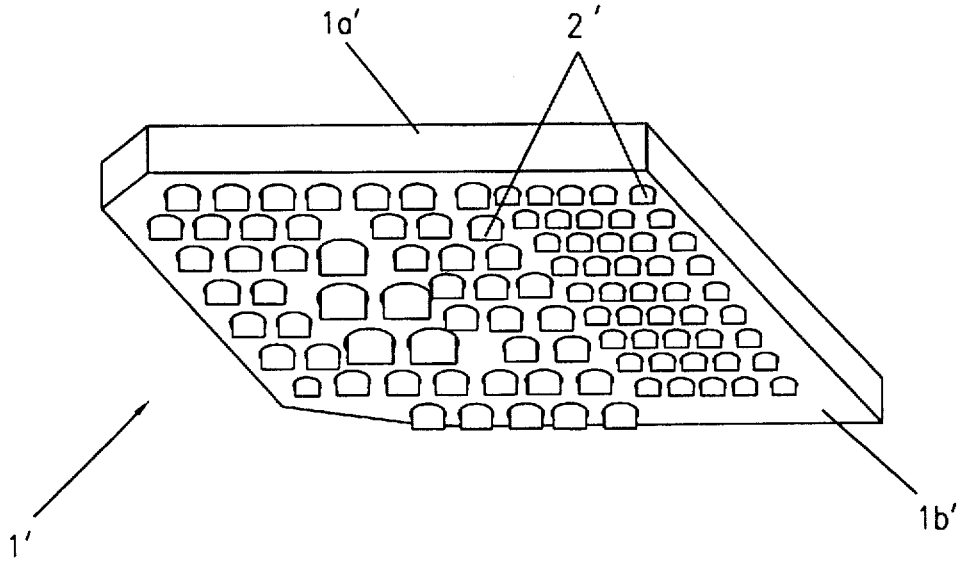
FIG. 5 is a perspective view depicting an alternative embodiment of the present invention die.
Figure 6:
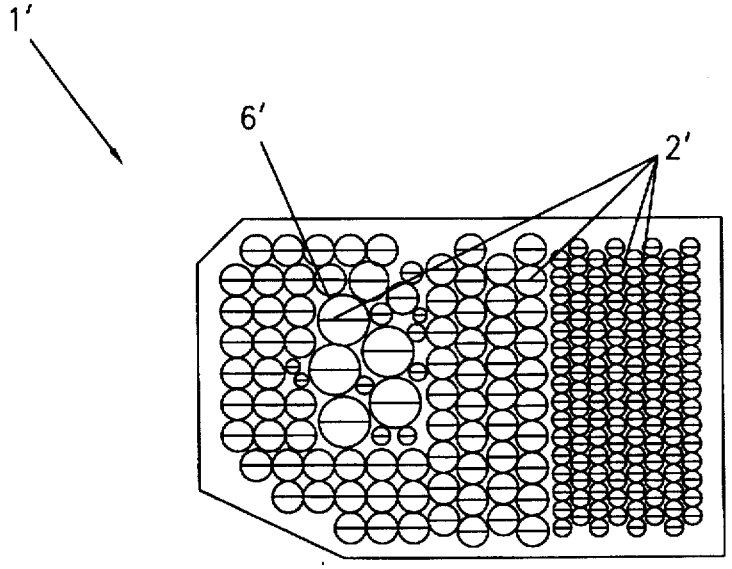
FIG. 6 is a bottom view of the die of FIG. 5 with a selected portion of the knives (shown in black as being extended) arranged in a pattern representing the desired contour to be scored and cut.

An alternative embodiment of the present invention die 1' is shown in FIGS. 5 and 6, with like parts being numbered in like fashion to FIGS. 2 and 3. This embodiment shows an alternative die shape, alternative arrangement of the knife array, and a variety of sizes of knives within a given die. These knives function in the same manner as described above.

It should be understood that various changes in the details and arrangement of parts which have been described herein and illustrated in order to explain the nature of this invention may be made by those skilled in the art within the principles and scope of the invention as expressed in the following claims. As such, the above is in no sense limiting, the shape of the die capable of being any desirable shape, the size and shapes of the knives varying, and the arrangement of the array being non-uniform. It should also be understood that the automatic reconfigurable die of the present invention can be used to cut/score a variety of materials including leather, fabric, paper, plastic, and other such materials.

What is claimed is:

1. An automatic reconfigurable die for scoring and cutting a sheet of material, comprising:

a bottom base portion having a plurality of knives attached thereto, and means for actuating each of the plurality of knives, wherein the means for actuating each of the plurality of knives includes means for pivotably orienting each of the plurality of knives about a respective longitudinal axis, and means for extending and retracting each of the plurality of knives along the respective longitudinal axis, and further wherein the automatic reconfigurable die includes control means for controlling the means for actuating such that operation of the control means allows a selected number of the plurality of knives to be oriented and extended to score and cut a selected piece of a material.

2. The automatic reconfigurable die of claim 1 wherein the control means includes a processor.

3. The automatic reconfigurable die of claim 2 wherein the control means further includes means for selecting a portion of the plurality of knives to form an array which forms a contour approximating a desired shape.

4. The automatic reconfigurable die of claim 1 wherein the plurality of knives are of varying sizes.

5. The automatic reconfigurable die of claim 1 wherein each of the plurality of knives includes means for scoring and cutting a sheet of material selected from the group consisting of: leather, fabric, and paper.

6. The automatic reconfigurable die of claim 1 wherein the means for pivotably orienting each of the plurality of knives includes an actuator.

7. The automatic reconfigurable die of claim 1 wherein the means for extending and retracting includes an actuator.

8. A automatic reconfigurable die for scoring and cutting a sheet of material, comprising:

a bottom base portion having a plurality of knives attached thereto, and means for actuating each of the plurality of knives, wherein the means for actuating each of the plurality of knives includes means for pivotably orienting each of the plurality of knives about a respective longitudinal axis, and means for extending and retracting each of the plurality of knives along the respective longitudinal axis, and further wherein the automatic reconfigurable die includes control means for controlling the means for actuating, and means associated with the control means for allowing real time, on-line computer planning selection of a group of knives selected from the plurality of knives, such that operation of the control means via the means associated with the control means allows the group of knives to be oriented and extended in real time to score and cut a selected piece of material.

9. The automatic reconfigurable die of claim 8 wherein the control means includes a processor.

10. The automatic reconfigurable die of claim 8 wherein the means associated with the control means includes a set of information.

11. The automatic reconfigurable die of claim 10 wherein the set of information includes material contour data and pattern layout data.

12. The automatic reconfigurable die of claim 8 wherein the control means further includes means for selecting a portion of the plurality of knives to form an array which forms a contour approximating a desired shape.

13. The automatic reconfigurable die of claim 8 wherein the plurality of knives are of varying sizes.

14. The automatic reconfigurable die of claim 8 wherein each of the plurality of knives includes means for scoring and cutting a sheet of material selected from the group consisting of: leather, fabric, and paper.

15. The automatic reconfigurable die of claim 8 wherein the means for pivotably orienting each of the plurality of knives includes an actuator.

16. The automatic reconfigurable die of claim 8 wherein the means for extending and retracting includes an actuator.

* * * * *